US005862816A

United States Patent [19]

Lowe

[11] Patent Number: 5,862,816

[45] Date of Patent: Jan. 26, 1999

[54] MIRROR-RAZOR COMBINATION AND METHOD

[75] Inventor: John R. Lowe, Orange County, Calif.

[73] Assignee: Lowe Technology Products

[21] Appl. No.: 914,666

[22] Filed: Aug. 19, 1997

[51] Int. Cl.[6] ..... A45D 27/29

[52] U.S. Cl. ..... 132/291; 248/467; 30/541

[58] Field of Search ..... 132/291, 316; D6/300, 301, 310; 248/467, 466; 211/70.7, 60.1; 30/541; D28/64.1, 64.3

[56] References Cited

U.S. PATENT DOCUMENTS

| | | | |
|---|---|---|---|
| Re. 32,906 | 4/1989 | Jones . | |
| D. 258,474 | 3/1981 | Edstrom . | |
| D. 282,993 | 3/1986 | Sanford . | |
| D. 303,599 | 9/1989 | Smith . | |
| D. 309,225 | 7/1990 | Scarbro . | |
| D. 324,463 | 3/1992 | Young | D6/300 |
| D. 335,598 | 5/1993 | Kerbs . | |
| D. 341,030 | 11/1993 | Jamieson . | |
| D. 343,737 | 2/1994 | Huttner . | |
| D. 346,699 | 5/1994 | Greger . | |
| D. 349,002 | 7/1994 | Greger . | |
| D. 368,128 | 3/1996 | McCarthy . | |
| D. 370,354 | 6/1996 | Deakyne . | |
| 1,622,114 | 3/1927 | Henry | 248/467 |
| 1,733,869 | 10/1929 | Edwards | 248/467 |
| 1,921,755 | 8/1933 | Karlson | 248/467 |
| 1,981,674 | 11/1934 | Solomon | 132/291 |
| 2,145,836 | 1/1939 | Parkins | 248/467 |
| 2,856,814 | 10/1958 | Dillmann | 248/467 |
| 3,273,891 | 9/1966 | Grim, Jr. | 248/467 |
| 3,478,996 | 11/1969 | Gunn . | |
| 4,072,397 | 2/1978 | Ross . | |
| 4,529,278 | 7/1985 | Nugent | 248/467 |
| 4,557,003 | 12/1985 | Jones . | |
| 4,611,716 | 9/1986 | Sorlien | 132/316 |
| 4,832,475 | 5/1989 | Daniels . | |
| 4,836,668 | 6/1989 | Christianson . | |
| 4,904,072 | 2/1990 | Chrintianson . | |
| 4,950,065 | 8/1990 | Wyman . | |
| 4,993,821 | 2/1991 | Christianson . | |
| 5,032,015 | 7/1991 | Christinason . | |
| 5,058,271 | 10/1991 | Jursich et al. . | |
| 5,313,337 | 5/1994 | Byers | 248/467 |
| 5,416,635 | 5/1995 | Christianson . | |
| 5,604,633 | 2/1997 | Christianson . | |
| 5,625,500 | 4/1997 | Ackerman | 248/467 |

*Primary Examiner*—Todd E. Manahan

*Attorney, Agent, or Firm*—John J. Connors; Connor & Associates

[57] ABSTRACT

A personal mirror constructed of a planar member having a reflective surface on a front face of a rectangular main body, a first flange extending rearward from a top edge of the main body at an acute included angle, and a suction-type attachment mechanism provided on the first flange and facing rearward to enable mounting of the mirror to a nonporous surface. A second flange may extend forward from a bottom edge of the main body and include at least one hole for receiving the handle of an accessory such as a razor, the hole being formed smaller than a head of the razor to allow the razor to hang from the flange. The planar member may be thermoplastic with the main body and first and second flanges integrally formed with first and second bends, respectively, therebetween. The bend between the second flange and the planar member is an obtuse angle and matched to the acute angle of the first bend so that the second flange extends generally horizontally when the mirror is wall-mounted. The first flange preferably includes slots or openings for securing at least two removable suction cups. The planar member, suction cups and a razor may be packaged together as a kit in a clear box or bag, and the entire kit is desirably disposable and marketed or distributed as a gratuity.

13 Claims, 8 Drawing Sheets

AD
RAZOR MATE
100
102
104
106
108
110
111
116
118
120
124
126
130
132
138
140
142
30
9
11

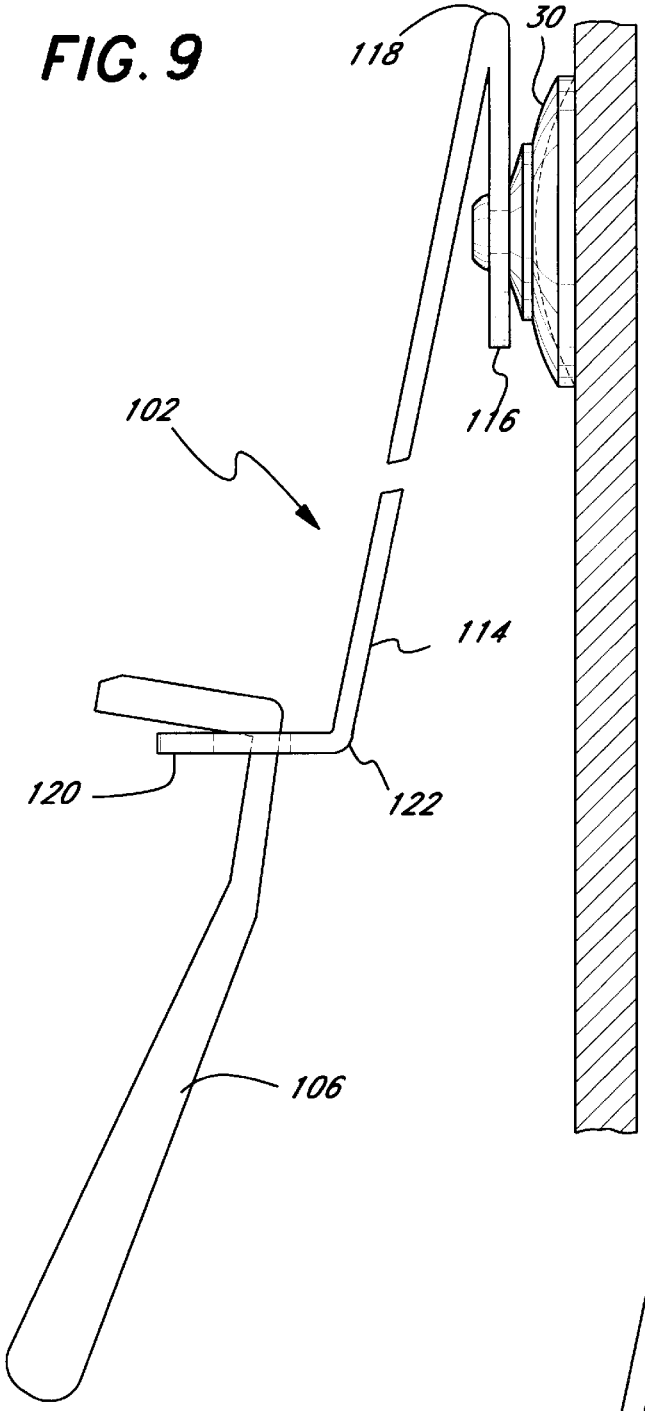
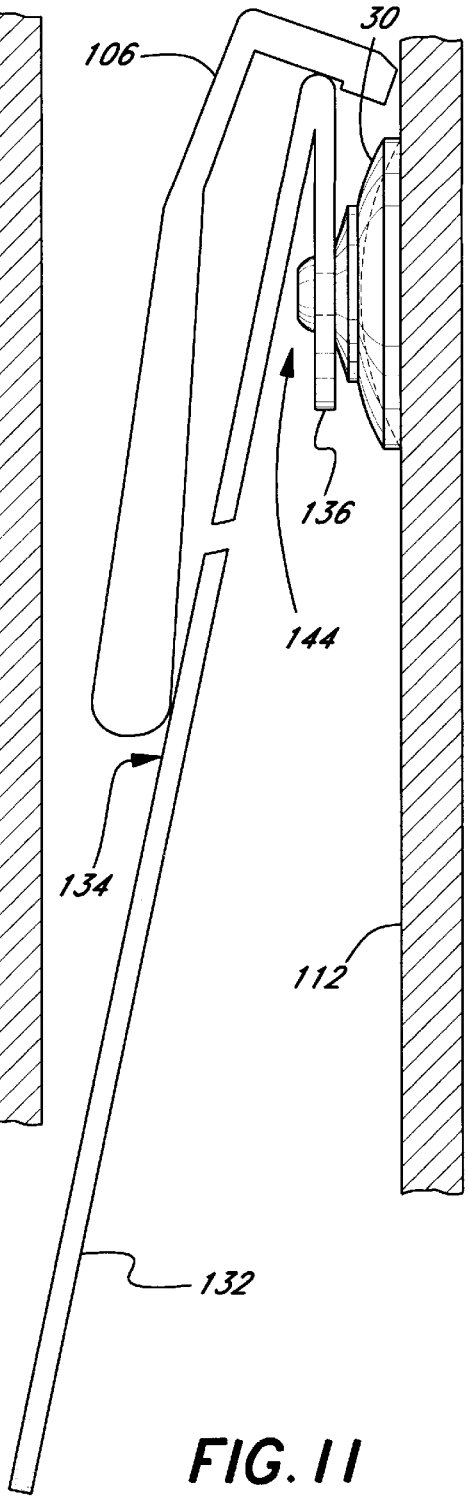
FIG. 11

MIRROR-RAZOR COMBINATION AND METHOD

BACKGROUND OF THE INVENTION

1. Field of the Invention

The present invention relates to personal hygiene aids and, more particularly, to a wallmounted portable and disposable mirror.

2. Background Discussion

Small hand held or personal mirrors are well known and have been adapted for travel. Some mirrors are configured as vehicular accessories with clips to attach to sun visors and the like. Personal mirrors are especially useful in bathrooms and showers for close-up facial examinations and grooming. Some personal mirrors are adapted to hang from the shower head to assist in shaving, and the more sophisticated of these include water circulation for defogging the lens. Unfortunately, most people do not own showerhead mounted mirrors, and even if they do they do not often include them in their luggage while traveling because of the bulk. Most personal mirrors are not well-suited for the bathroom environment because they do not have special mounting hardware and thus cannot be oriented conveniently. Moreover, hand held mirrors by their nature are not fixed in place and can fall and break, creating a serious hazard from the broken shards of glass. There is thus a need for a safer personal mirror for bathroom and shower usage which is at the same time both inexpensive and lightweight.

SUMMARY OF THE INVENTION

It is the objective of this invention to provide an inexpensive mirror which may be removably attached to a wall, for example a wall in a shower, that is convenience to use and will not easily break.

This invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include low cost, safety, convenience of use, and a vehicle for advertising.

The first feature of the mirror of this invention is that it is adapted to be mounted to a wall. It includes a mirror member having a body with a longitudinal axis and including a front mirror surface, a back surface, a top, and a bottom. Preferably, the mirror member is a substantially planar, substantially rectangular structure made of a thermoplastic material, for example, an acrylic or polycarbonate plastic. Such thermoplastic material is tough and difficult to break, and does not shatter like glass. Therefore, it is safe to use in, for example, a shower.

The second feature is a first flange member at the top integral with the mirror member. This first flange member is formed by bending the body of the mirror member along a line which is substantially perpendicular to the longitudinal axis of the mirror member to form an acute angle between the back surface and the flange member. The acute angle ranges between 5 and 15 degrees. A suction cup type attachment mechanism extends outward from the first flange member to enable the mirror to be mounted to the wall. Preferably, there is a cut-a-way section in the first flange member for removably mounting the suction cup type attachment mechanism to the first flange member.

The third feature is that the suction cup type attachment mechanism includes a cup portion which faces the wall to which the mirror is to be attached and a head member which is attached to the first flange member. This suction cup type attachment mechanism is disposed between the back of the mirror member and an inside surface of the first flange member. There is a gap between the back surface of the mirror and the head member, and the head member acts as a stop which limits the movement of the mirror member towards the head member when the mirror is mounted to the wall. The line at which the first flange member is integral with the mirror member acts as a pivot about which the mirror member may be manually flexed relative to the first flange member. This gap is from 1/16 to 1 inch.

The fourth feature a razor holder along the bottom of the mirror member. This razor holder includes at least one hole therein that allows a handle of a razor to the inserted into the hole and a head of the razor to be supported by the razor holder. Preferably, the razor holder comprises a second flange member formed by bending the body of the mirror member along a line near the bottom which is substantially perpendicular to the longitudinal axis of the mirror member to form an obtuse angle between the mirror surface and the second flange member. The obtuse angle ranges between 95 and 105 degrees. This orients the send flange generally horizontally when the mirror is attached to a vertical support surface.

The fifth feature is that the first flange member at the top integral of the mirror member formed by bending the body of the mirror member along a line which is substantially perpendicular to the longitudinal axis of the mirror member may be formed into an angle which is grater than 180 degrees (about 185–195 degrees) between the back surface and the first flange member. In such an embodiment, the attachment mechanism preferably is double sided tape with both sides bearing an adhesive. The tape has one side secured to the flange member and the other side is used to attach the mirror to a vertical support structure. When a razor holder is at the bottom in a form of the second flange, this second flange is substantially at a right angle with respect to the vertical support structure.

The sixth feature is that the use of the thermoplastic material makes it easy to form the first and second flange members in the mirror member by heating the material to its softening point. When so heated the mirror member is simply bend along the lines defining junctions between the first and second flange members and the remaining body of the mirror member.

The seventh feature is that a mounting member for a mirror is provided. This mounting member preferably is an injection molded part made from, for example, polypropylene and it has a front surface, a back surface, a top, and a bottom. A mirror is secured to the front surface of the mounting member. There is a flange member at the top integral with the mounting member which forms an acute angle between the back surface and the flange member. Preferably, a suction cup type attachment mechanism is removably attached to extend outward from the flange member to enable the mirror to be mounted to a wall or similar vertical support structure.

This invention also comprises a kit, including (a) a mirror member having a body with a longitudinal axis and including a mirror surface, a back surface, a top, and a bottom, a first flange member attached near the top of the body of the mirror member to form an acute angle between the back surface and the flange member, and a razor holder comprising a second flange member attached near the bottom of the body of the mirror member to form an obtuse angle between the mirror surface and the second flange member, said razor holder including at least one hole therein that allows a handle of a razor to the inserted into the hole and a head of the razor to be supported by the razor holder, (b) a suction cup type attachment mechanism adapted to be attached to the first flange member to extend outward from the first flange member to enable the mirror to be mounted to the wall, and (c) a razor having a head and handle, with the handle of the razor adapted to be inserted into the hole and the head of the razor adapted to be supported by the razor holder.

This invention also includes a method of shaving in the shower or tub, for example. This method includes:

(a) providing a mirror member having a body with a longitudinal axis and including a mirror surface, a back surface, a top, and a bottom, at said top a flange member integral with the mirror member and formed by bending the body of the mirror member along a line which is substantially perpendicular to the longitudinal axis of the mirror member to form an acute angle between the back surface and the flange member, and a suction cup type attachment mechanism for attachment to the flange member to enable the mirror to be mounted to the wall, (b) providing a razor, and (c) mounting the mirror member to a wall using the suction cup type attachment mechanism to attach said mirror member to the wall by the flange member in a position to allow a user to see his or her image in the mirror surface while using the razor to shave.

DESCRIPTION OF THE DRAWING

The preferred embodiments of this invention, illustrating all its features, will now be discussed in detail. These embodiments depict the novel and non-obvious mirror, kit, and method of this invention as shown in the accompanying drawing, which is for illustrative purposes only. This drawing includes the following figures (FIGS.), with like numerals indicating like parts:

FIG. 9 is a side elevational view of the single razor mirror taken along line 9—9 of FIG. 8 with the mirror attached to a wall shown in section;

FIG. 11 is a side elevational view of the mirror of FIG. 10 attached to a wall shown in section;

DETAILED DESCRIPTION OF THE PREFERRED EMBODIMENTS

The present invention is a personal mirror convenient for travel and inexpensively made, so as to be suitable for advertising and promotional give-aways. The mirror is preferably formed of a monolithic, planar member with a mirror surface coated on one side and at least one flange formed by bending a top end of the body rearward to define a mounting flange. The mounting flange preferably includes a cut-away section for receiving a suction cup type attachment mechanism. The suction cups, mirror and any accessories such as a razor or razors can be grouped together in an attractive display as a kit. Although the mirror is described in its preferred form, those of skill in the art will recognize that various other constructions are possible. For example, though the present mirror is well suited for mass production and low cost, it could also be constructed of more durable or expensive materials and marketed to upscale customers.

Figure 1:
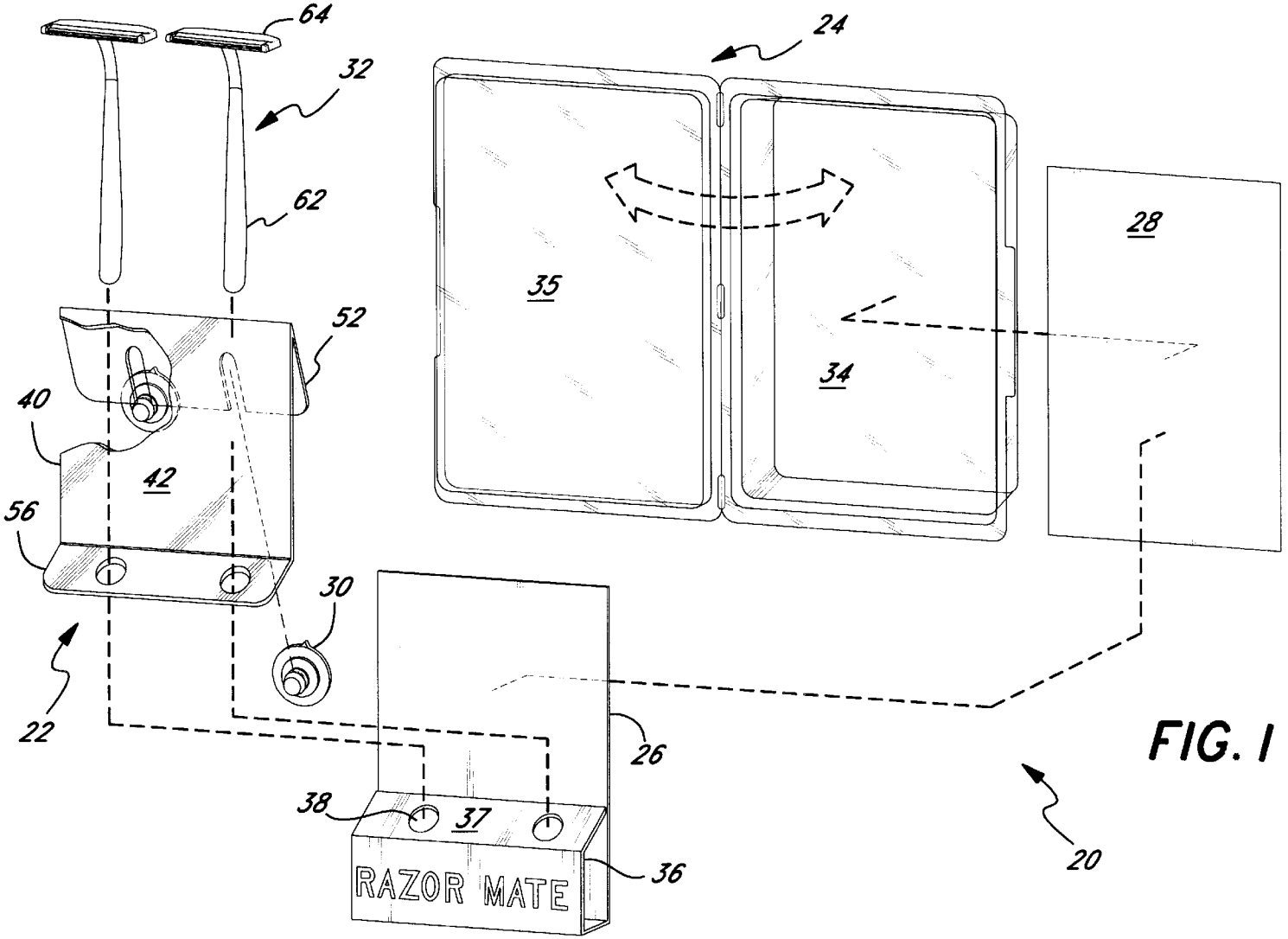
FIG. 1 is a perspective exploded view of a personal mirror and double razor kit of the present invention.

With reference to FIGS. 1–5, one embodiment of the personal mirror adapted to support two razors as accessories is shown. FIG. 1 illustrates the entire kit 20 including the personal mirror 22, a display box 24, a front panel 26, a back panel 28, a pair of suction cups 30, and a pair of conventional disposable razors 32. As shown by the dashed lines, the back panel 28 fits flush against a rear wall 34 of the display box 24 and the front panel 26 lies flush against the back panel. The display box 24 is preferably made of a clear plastic with a hinged front door 35 so that the back panel 28 is visible therefrom to display instructions for use or other information. The front panel 26 is desirably formed of a single piece of cardboard folded three times at the bottom end to define a stand 36 for the personal mirror 22. The final fold of the stand 36 forms an angled wall 37 including a pair of spaced apertures 38.

Figure 2:
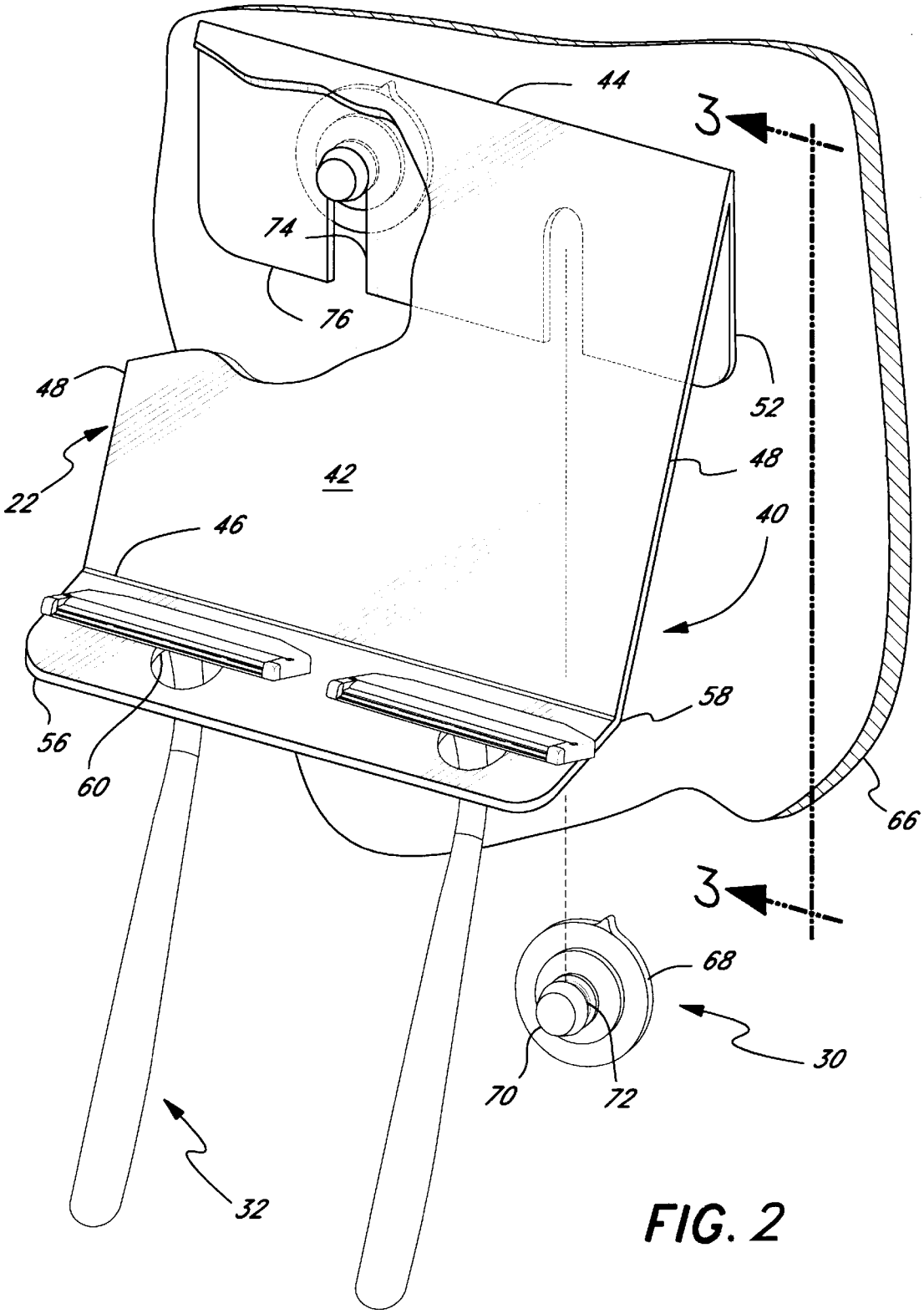
FIG. 2 is a perspective view of the mirror of this invention cut away to show one suction cup attaching the mirror to a wall and another suction cup exploded away to expose an attachment slot in the mirror.
Figure 3:
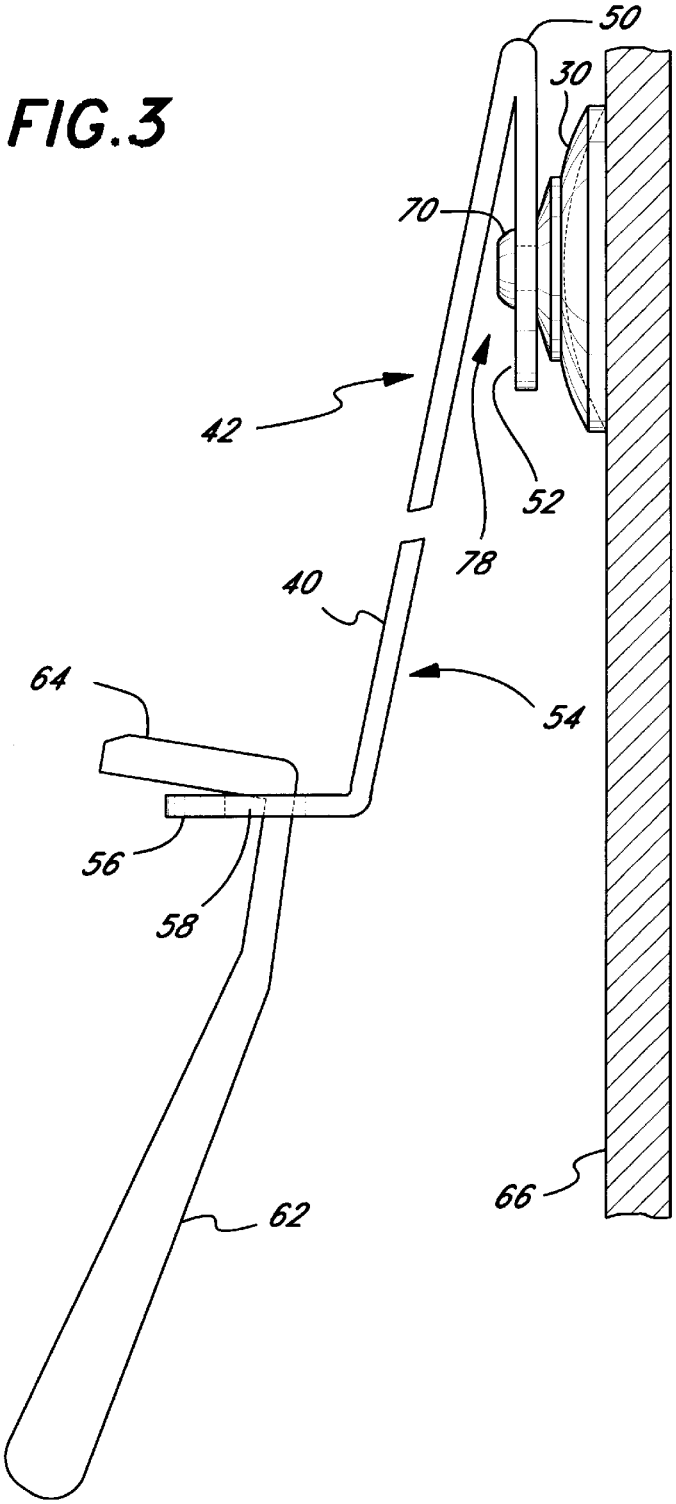
FIG. 3 is a side elevational view of the mirror of FIG. 2 taken along line 3—3 of FIG. 2 with the mirror attached to a wall shown in section.
Figure 4:
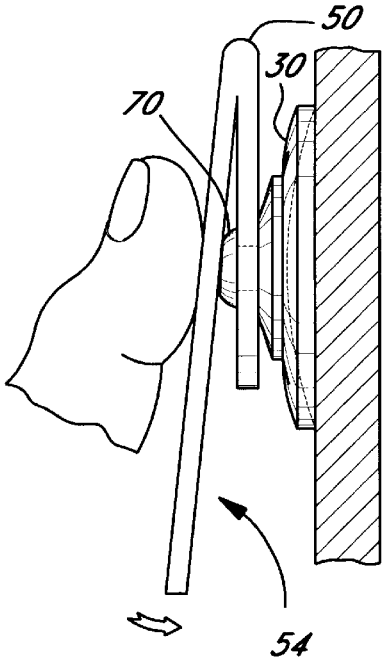
FIG. 4 is an enlarged side view of the mirror of FIG. 3 showing a person's finger flexing the mirror about an upper bend.

As seen best in FIG. 2, the personal mirror 22 comprises a mirror body 40 having a mirror surface 42 bounded by a top edge 44, a bottom edge 46, and a pair of parallel sides 48 defining therebetween a mutually parallel longitudinal axis (not shown). The mirror body 40 may take a number of shapes and the present scope of protection should not be limited by the illustrations. In its preferred form, however, the mirror body 40 is a rectangular, planar, thermoplastic, and the mirror surface 42 is a reflective coating applied to the body. The top edge 44 is perpendicular to the longitudinal axis and coincident with an upper bend 50 between the mirror body 40 and a mounting flange 52, as seen in FIG. 3. The mounting flange 52 defines an acute angle with a back surface 54 of the mirror body 40. Preferably, the acute angle is between 5° and 15°.

The dual razor personal mirror 22 of FIG. 1 also includes a second flange 56 angled from the bottom edge 46 in a direction opposite from the mounting flange 52 to form a lower bend 58. This second or holder flange 56 defines an obtuse angle with the mirror surface 42. Preferably, the obtuse angle is between 95 and 105. The personal mirror 22 is best suited to attach to a flat, vertical surface with the mirror surface 42 facing forward so that the mounting flange 52 is bent rearward, and the holder flange 56 is bent forward. The angled wall 37 in the stand 36 having the apertures 38 makes the same obtuse angle with the front panel 26 as does the holder flange 56 makes with the mirror surface 42.

With reference again to FIG. 1, therefore, the personal mirror 22 rests on the stand 36 with the back surface 54 facing the front panel 26 and the holder flange 56 resting on the stand 36. The holder flange 56 includes a pair of spaced suspension holes 60 which align with apertures 38 in the stand 36. A handle 62 on each of the razors 32 is received in the aligned holes 60 and apertures 38, with a head 64 of each razor being supported or suspended from the flange 56. With the mirror 22 and razors 32, the suction cups 30 complete the kit 20. It will be understood that the holder flange 56 may support other items such as toothbrushes, makeup or grooming implements, or other such various and sundry items. Furthermore, a lip or other such structure may be provided on the flange 56 to prevent items placed directly on the flange surface from rolling off.

Figure 5:
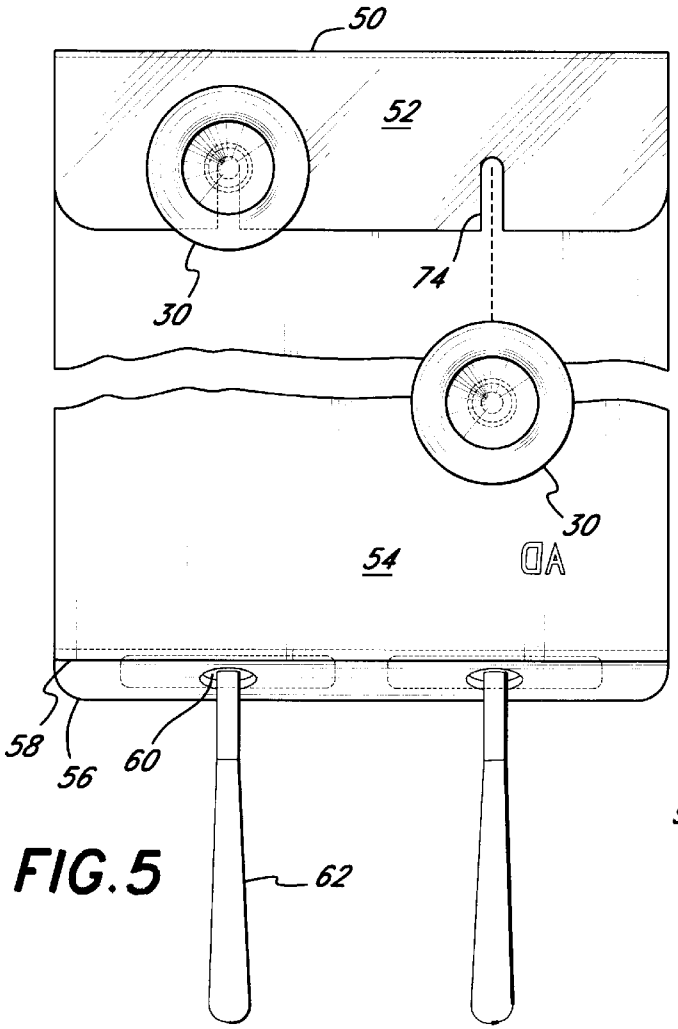
FIG. 5 is a rear elevational view of the mirror of FIG. 2.

With reference now to FIGS. 2 and 5, a convenient means for attaching the personal mirror 22 to a non-porous wall 66 will be described. The suction cups 30 include a flared cup portion 68 defining a suction surface, and a head member 70. The head member 70 is attached to the side opposite of the suction surface by a neck 72. The rear mounting flange 52 of the personal mirror 22 includes a pair of slots 74 opening to a bottom edge 76. The head member 70 is wider than the neck 72, the width of the slots 74 is approximately the same as the neck 72, and the thickness of the mounting flange 52 is approximately the same as the length of the neck. As shown in FIGS. 2 and 5, therefore, the suction cups 30 are attached to the mounting flange 52 by inserting the neck 72 into each slot 74 in a friction fit to prevent the cups 30 from coming out.

FIG. 3 illustrates the respective angles each portion of the personal mirror 22 makes with the wall 66. The mounting flange 52 is parallel to the wall 66, the mirror body 40 forms a downward acute angle, and the holder flange 56 is approximately perpendicular to the wall. In its preferred form, the downward angle the mirror body 40 makes with the wall 66 is great enough so that a gap 78 is formed between the head member 70 of each suction cup 30 and the back surface 54. This helps prevent the mirror 22 from being disengaged from the wall 66. That is, with reference to FIG. 4, pressure on the mirror surface 42 from, for example, a person's finger 80 causes the mirror body 40 to pivot about the upper bend 52 in the direction shown by the arrow 82. Because of the gap 78, the upper bend 52 is placed in bending stress and absorbs some of the force applied by the finger 80 prior to the suction cups 30 being subjected to a moment tending to pry them from the wall. That is, undue pressure on the front of the mirror body 40 eventually causes the back surface 54 to contact the head member 70 and thereafter the body 40 pivots around the head member. This moment and fulcrum design of the head 70 eventually act to lift an upper edge of the cup portion 30 away from the wall. With the gap 78, however, slight bumps and knocks to the mirror body 40 are first absorbed in flexure at the upper bend 52 before acting to pry the suction cups 30 from the wall. The same principle would apply with a hinge at the upper bend 52 and a spring between the suction cup and mirror body.

Figure 6:
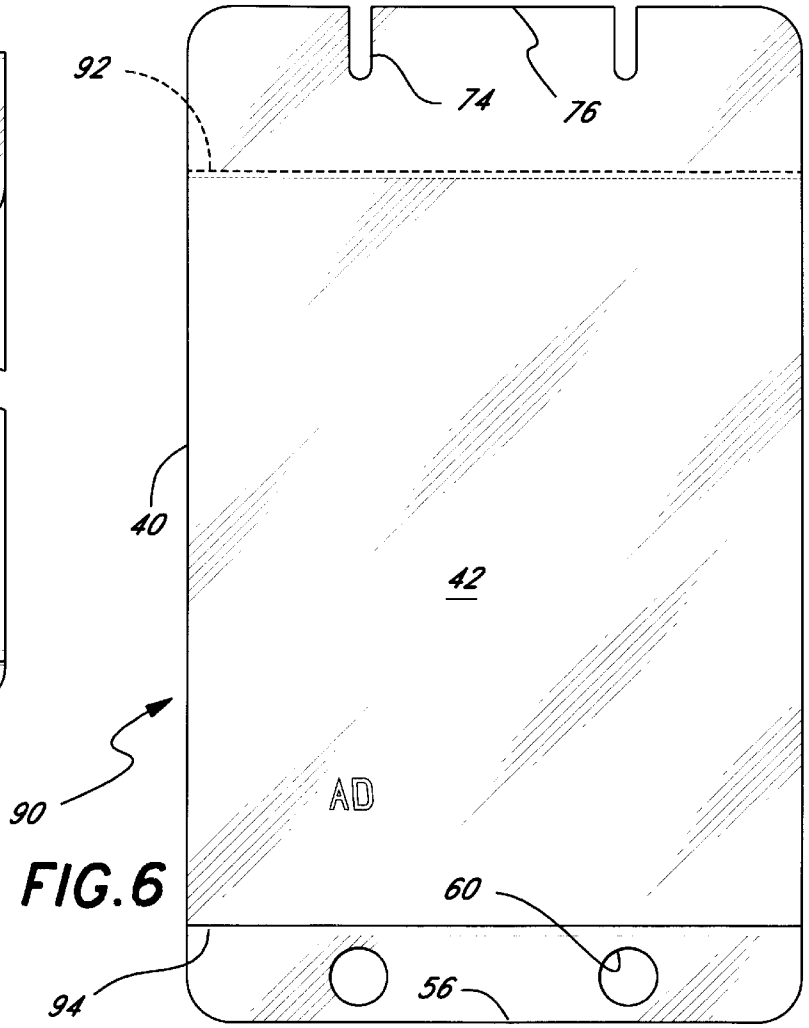
FIG. 6 is a front plan view of a planar mirror member used to construct the mirror of FIG. 2.

FIG. 6 shows a single planar member 90 used to form the double razor personal mirror 22. The mirror body 40 having the mirror surface 42 is shown in the center with the mounting flange 52 at a top end and the holder flange 56 at the bottom. The slots 74 open to the top end of the member 90. An upper relief groove 92 is formed in the back surface of the member 90 to accommodate the upper bend 50, and a lower relief groove 94 is formed in the front surface of the member to accommodate the lower bend 58. The relief grooves 92 and 94 enable the member 90 to be bent into the shape of the mirror 22 without undue compression and buckling of the material on the inside of the two bends 50 and 58.

Figures 7, 8, 10:
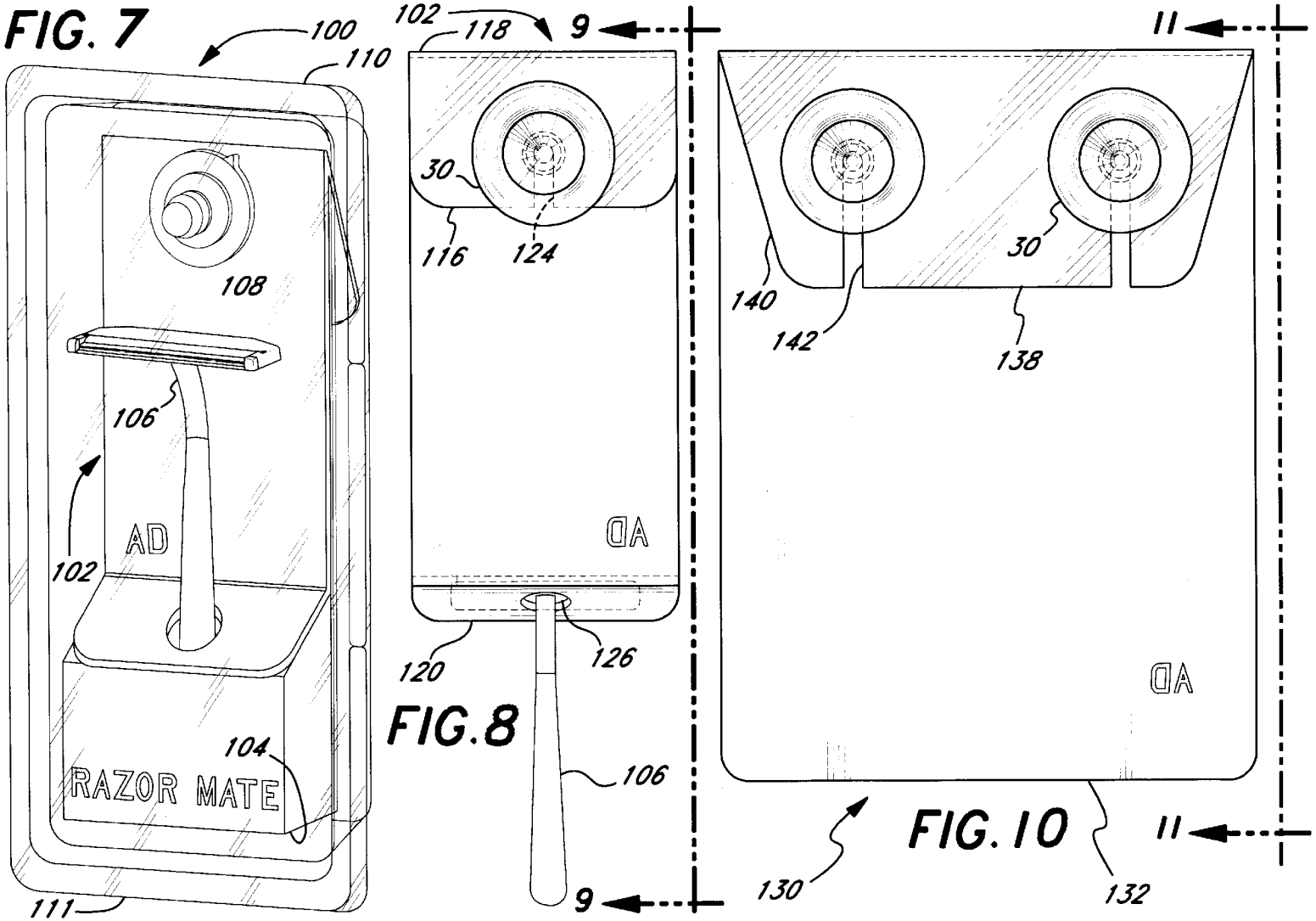
FIG. 7 is a perspective assembled view of a personal mirror and single razor kit of the present invention.
FIG. 8 is a rear elevational view of the mirror removed from in the kit of FIG. 7.
FIG. 10 is a rear elevational view of a further embodiment of the personal mirror of the present invention.

FIG. 7 illustrates an individual shaving kit 100 including a personal mirror 102, a support stand 104, a razor 106 and a suction cup 108. The kit 100 is housed in a clear plastic display box 110 with a hinged front door 111. The personal mirror 102 is shown from behind in FIG. 8, and from the side attached to a wall 112 in FIG. 9. As with the first personal mirror 22, the mirror 102 includes a planar mirror body 114 attached to a mounting flange 116 at an upper bend 118, and to a holder flange 120 extending forward from the body at a lower bend 122. The mounting flange 116 includes a single slot 124 for receiving a suction cup 30, identical to the suction cup described previously. The holder flange 120 includes a centered suspension hole 126 for receiving the razor 106. In all other aspects, the construction of the personal mirror 102 is the same as the personal mirror 22.

Figure 15:
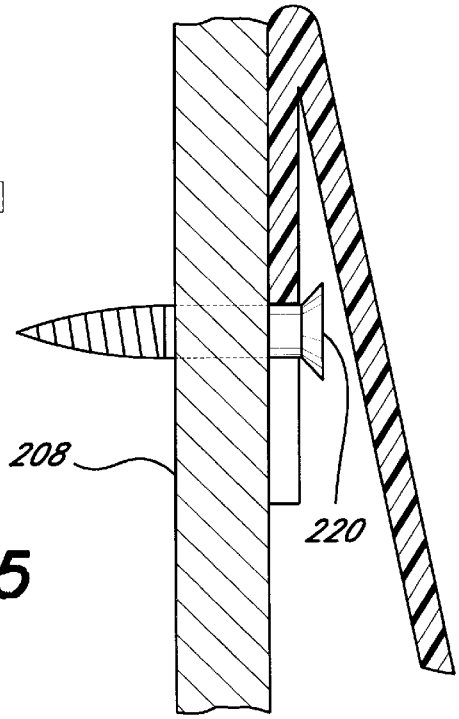
FIG. 15 shows a mirror is similar to the one one depicted in FIG. 11, but the suction cups are eliminated and the mirror is attached to a screw in a wall.

FIGS. 10 and 11 illustrate a further embodiment of a personal mirror 130 without the razor holder flange. The mirror 130 includes a mirror body 132 having a frontal mirror surface 134 and attached to a mounting flange 136 at an upper bend 138. The mounting flange 138 has tapered side edges 140 and a pair of vertical slots 142 for receiving suction cups 30. The acute angle between the mirror body 132 and the mounting flange 136 is preferably the same as in the earlier embodiment with a gap 144 provided between the suction cup 30 and the mirror body. Because the mirror 130 does not have a lower flange, it presents a thinner profile and may be packaged in a smaller container. The upper bend 138 of the mounting flange 136 may be used to support the razor 106. As shown in FIG. 15, it is possible to avoid using the suction cups and simply mount the mirror 130 to a wall 208 using a screw or screws 220 which slides into the vertical slots 142.

Figure 12:
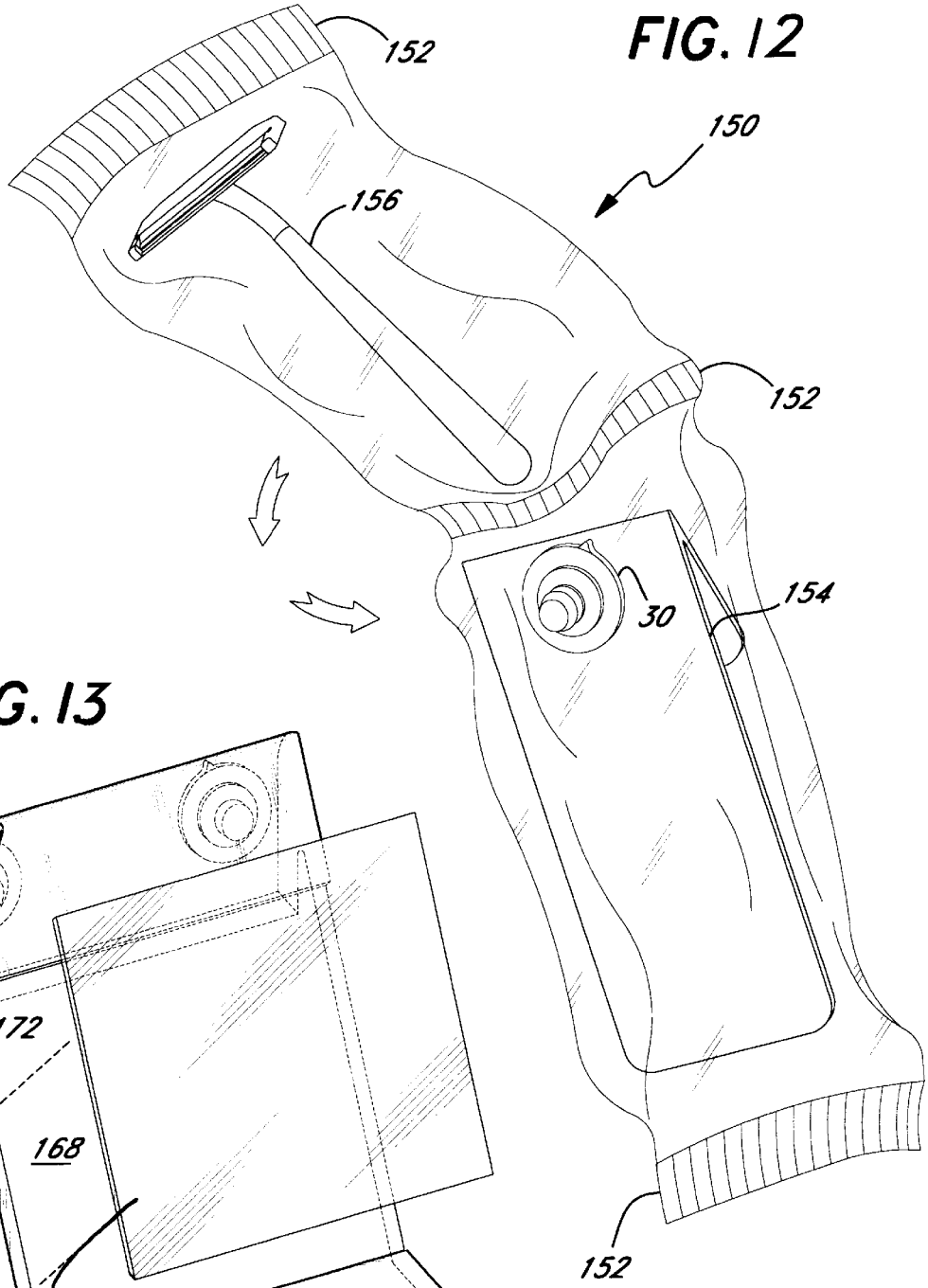
FIG. 12 is a perspective view of an alternative construction of the personal mirror of the present invention, and a display container in the form of a series of heat sealed bags.

FIG. 12 shows a plurality of end-to-end display bags 150 connected together at heat seals 152. One bag may contain a mirror 154 similar to but narrower than that shown in FIG. 10, while a second bag contains a razor 156 or other such item. The only other element in the kit is a suction cup 30 for attaching the mirror 152 to a wall. This kit version is most suitable for one or two shaves before discarding the components.

Figure 13:
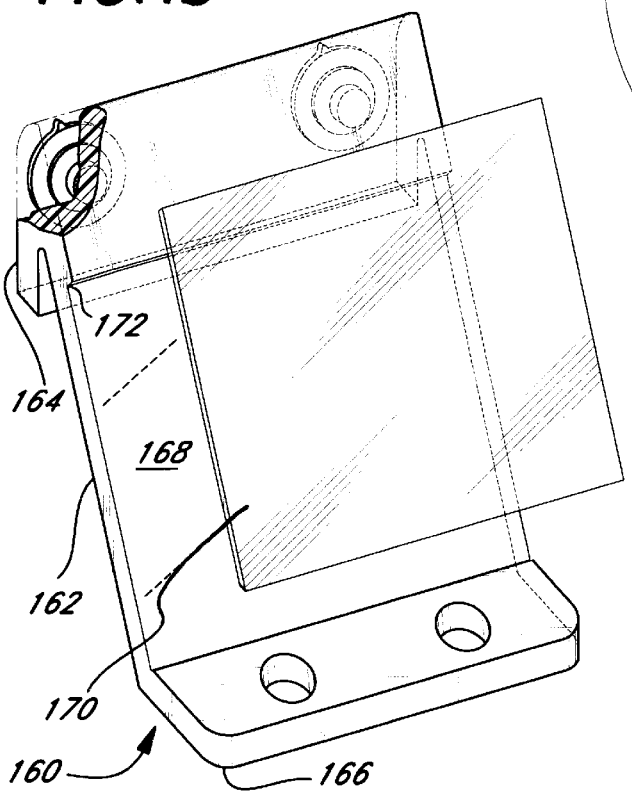
FIG. 13 is an exploded perspective view of a further embodiment of the personal mirror including a mounting member with a mirror attached to this member.

A further embodiment of a personal mirror 160 of the present invention is seen in FIG. 13. This version is slightly thicker and may be injection molded or otherwise fabricated from plastic or other lightweight material. The mirror 160 comprises a body or mounting member 162 having a rear mounting flange 164, a front tool support flange 166, and a support surface 168. A separate mirror member 170 is positioned on the support surface 168 within a shallow recess 172 in the front surface of the body 162. The mirror member 170 may be of conventional glass construction or even polished metal.

The various mirrors described and shown herein is preferably formed by machining, heating and bending thermoplastics to shape. They typically have a thickness of 1/16 to 1/4. These mirrors, however, may be injection molded or fabricated using other means dictated by the choice of materials. Several particularly easy to form and inexpensive materials are generally classed as thermoplastics including but not limited to acrylic and polycarbonate materials. A primary design concern with versions of the mirror as illustrated is weight because of the use of suction cups to mount the mirror to a nonporous wall, and because the kits are highly convenient travel items. Thermoplastics are relatively low density and lightweight. Typically, the weight of the mirrors of this invention do not exceed one or two ounces. Another consideration is corrosion resistance because of the intended use in the shower.

If the mirror is constructed of thermoplastic and sealed in an inexpensive container, such as the heat sealed bags 150 of FIG. 12, then the kits are especially well suited for promotional or other giveaways. Hotels, for example, might provide single or double razor kits in each of the rooms along with the other complementary items such as shampoo, mouthwash and coffee. In a still further advantageous use of the present invention special kits may be designed for camping with low profile lightweight components and a mounting structure suitable for the outdoors. Furthermore, the low cost of the mirror kits makes them easily replaceable and disposable after use on a weekend trip, for example. The material used may even be recyclable to help prevent an increase in solid waste. In short, the complete personal mirror and shaving kit is adaptable to a multitude of travel or other environs and provides convenience and utility in a small package.

Figure 14:
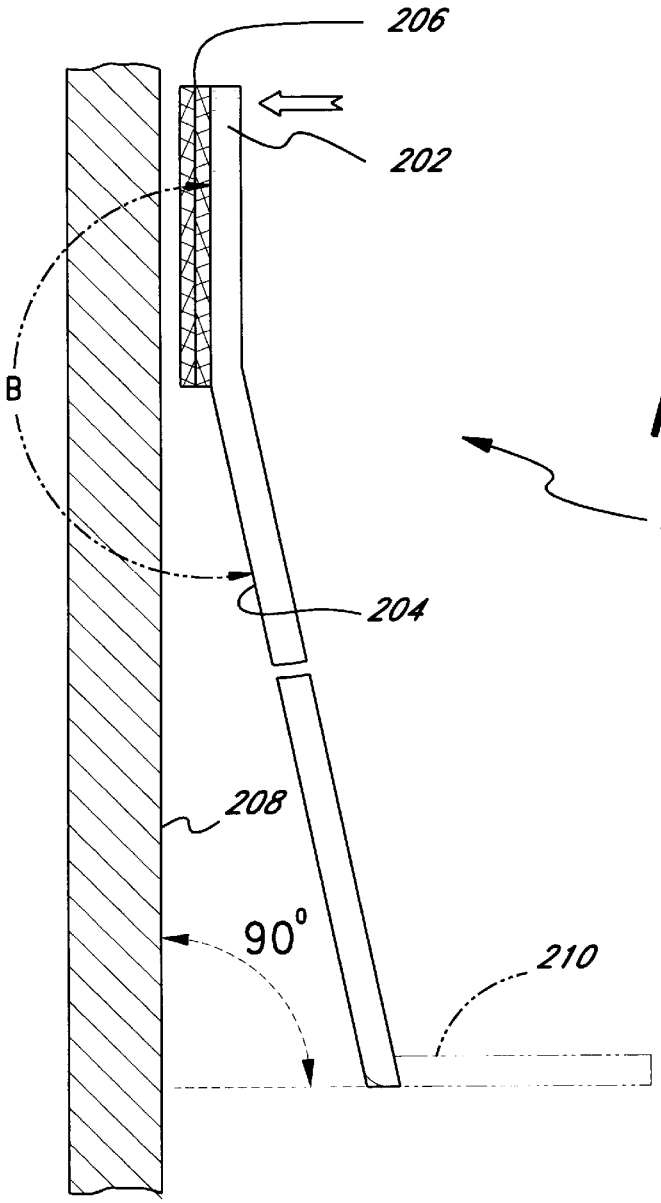
FIG. 14 is still another embodiment of this invention where the flange at the top of the mirror is at an obtuse angle with respect to the back of the mirror.

FIG. 14 depicts a mirror 200 similar to that shown in FIGS. 10 and 1, except that a mounting flange 202 is at an angle with respect to the back surface 204 of this mirror which is greater than 180 degrees. The flange member 202 at the top integral of the mirror member is formed by bending the body of the mirror member along a line which is substantially perpendicular to the longitudinal axis of the mirror member to form the angle B (about 195 degrees). In such an embodiment, the attachment mechanism preferably is double sided tape 206 having opposed sides bearing an adhesive. The tape 206 has one side secured to the flange member and the other side attach to a vertical support structure such as a wall 208. When a razor holder is at the bottom in a form of the second flange 210 (shown in phantom lines), this second flange is substantially at a right angle with respect to the wall 208.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

I claim:

1. A mirror including a body made from a monolithic, thermoplastic planar member with a longitudinal axis, said body including a front member having a front mirror surface, a back surface, a top, and a bottom, and a flange member at the top which is integral with said front member and is formed from the monolithic, thermoplastic planar member by bending said planar member along a line which is substantially perpendicular to the longitudinal axis to form an acute angle between the back surface and the flange member, said flange member having an outer surface with an attachment mechanism extending from said outer surface to enable the mirror to be mounted to a vertical wall.

2. The mirror of claim 1 where the attachment mechanism is a suction cup type member extending outward from the outer surface of the flange member.

3. The mirror of claim 2 where there is a cut-away section in the first flange member for removably mounting the suction cup type member to the flange member.

4. The mirror of claim 2 where the suction cup type member includes a cup portion which faces the wall to which the mirror is to be attached and a head member which is attached to the flange member and is disposed between the back surface of the front member and an inside surface of the flange member.

5. The mirror of claim 4 where there is a gap between the back surface of the front member and the head member, said head member acting as a stop which limits the movement of the front member towards the flange member when the front member and flange member are manually pushed together.

6. The mirror of claim 5 where the gap is from 1/16 to 1 inch.

7. The mirror of claim 1 where the attachment mechanism is a double sided tape having opposed sides bearing an adhesive.

8. The mirror of claim 1 where the attachment mechanism is a screw member.

9. The mirror of claim 1 where the flange member pivots along said line upon a force being applied to push the front member and flange member together to enable the front member to be manually flexed.

10. A mirror including a body made from a monolithic, thermoplastic planar member with a longitudinal axis, said body including a front member having a front mirror surface, a back surface, a top, and a bottom, a mounting flange member at the top which is integral with said front member and is formed from the monolithic, thermoplastic planar member by bending said planar member along a line which is substantially perpendicular to the longitudinal axis to form an acute angle between the back surface and the flange member, and a razor holder flange member at the bottom which is integral with said front member and is formed from the monolithic, thermoplastic planar member by bending said planar member along a line which is substantially perpendicular to the longitudinal axis to form an obtuse angle between the mirror surface and the razor holder flange member, said razor holder flange member including at least one hole therein that allows a handle of a razor to the inserted into the hole and a head of the razor to be supported by the razor holder, an attachment mechanism extending from an outer surface of the mounting flange member to enable the mirror to be mounted to a vertical wall.

11. The mirror of claim 10 where the mounting flange member pivots along said line upon a force being applied to push the front member and mounting flange member together to enable the front member to be manually flexed.

12. A kit including a package holding the following components (a) a body made from a monolithic, thermoplastic planar member with a longitudinal axis, said body including a front member having a front mirror surface, a back surface, a top, and a bottom, a mounting flange member at the top which is integral with said front member and is formed from the monolithic, thermoplastic planar member by bending said planar member along a line which is substantially perpendicular to the longitudinal axis to form an acute angle between the back surface and the flange member, and a razor holder flange member at the bottom which is integral with said front member and is formed from the monolithic, thermoplastic planar member by bending said planar member along a line which is substantially perpendicular to the longitudinal axis to form an obtuse angle between the mirror surface and the razor holder flange member, said razor holder flange member including at least one hole therein that allows a handle of a razor to the inserted into the hole and a head of the razor to be supported by the razor holder, (b) a suction cup type attachment mechanism adapted to be attached to the mounting flange member to extend outward from the mounting flange member to enable the mirror to be mounted to a wall, and (c) a razor having a head and handle, with the handle of the razor adapted to be inserted into the hole and the head of the razor adapted to be supported by the razor holder.

13. A method of shaving with a razor and storing the razor, comprising (a) providing a mirror including a body made from a monolithic, thermoplastic planar member with a longitudinal axis, said body including a front member having a front mirror surface, a back surface, a top, and a bottom, a mounting flange member at the top which is integral with said front member and is formed from the monolithic, thermoplastic planar member by bending said planar member along a line which is substantially perpendicular to the longitudinal axis to form an acute angle between the back surface and the flange member, and a razor holder flange member at the bottom which is integral with said front member and is formed from the monolithic, thermoplastic planar member by bending said planar member along a line which is substantially perpendicular to the longitudinal axis to form an obtuse angle between the mirror surface and the razor holder flange member, said razor holder flange member including at least one hole therein that allows a handle of a razor to the inserted into the hole and a head of the razor to be supported by the razor holder flange member, an attachment mechanism extending from an outer surface of the mounting flange member to enable the mirror to be mounted to a vertical wall, (b) providing a razor with a handle attached to a head of the razor, (c) mounting the mirror to a vertical wall using the attachment mechanism to attach said mirror member to the wall by the mounting flange member in a position to allow a user to see his or her image in the mirror surface while using the razor to shave, (d) shaving using the razor, and (e) storing the razor in the razor holder flange member by inserting the handle in the hole in the razor holder flange member with the head being supported by the razor holder flange member.

* * * * *